US005988831A

United States Patent [19]

Pan

[11] Patent Number: 5,988,831

[45] Date of Patent: Nov. 23, 1999

[54] STUCTURE USED FOR RECTANGULARLY ARRAYED MINIATURE LIGHT BULB SERIES

[76] Inventor: Wun Fang Pan, No. 125, Lane 99, Dinpu Road, Hsinchu, Taiwan

[21] Appl. No.: 09/021,486

[22] Filed: Feb. 10, 1998

[51] Int. Cl.[6] ..... H05B 41/14

[52] U.S. Cl. ..... 362/227; 362/806; 362/145; 315/185 R; 315/185 S

[58] Field of Search ..... 362/249, 250, 362/251, 252, 145–153, 806, 807–811; 315/185.5, 210, 185 R, 185 S, 186–193

[56] References Cited

U.S. PATENT DOCUMENTS 5,828,183 10/1998 Wang et al. ..... 315/185.5

*Primary Examiner*—Thomas M. Sember
*Assistant Examiner*—Ismael Negron
*Attorney, Agent, or Firm*—Rosenberg, Klein & Bilker

[57] ABSTRACT

A structure is provided which is used for a rectangularly arrayed miniature light bulb series. The structure includes a first controller (3) which regulates and controls the current in a first light bulb string (1). A second controller (4) regulates and controls the current in a second light bulb string (2). The first and second light bulb strings (1) and (2) are joined in series by a first connecting conductive wire (5) and the second controller is in electrical communication with the first light bulb string (1) through a second connecting conductive wire (6). In this manner, light bulbs in light strings (1) and (2) may be coordinated with each other.

3 Claims, 5 Drawing Sheets

STUCTURE USED FOR RECTANGULARLY ARRAYED MINIATURE LIGHT BULB SERIES

SUMMARY OF THE INVENTION

To display light bulbs in a rectangular array form, prior arts typically use a transverse conductive wire connected to a power source and provided with a multiple port socket to which a plurality of short light bulb series is attached. Such arrangements have a disadvantage that the connection between short light bulb series and the multiple port socket does not have sufficient strength supporting heavy weights that may be caused by light bulb series itself and resisting unintentional dragging forces. The weakness often leads to failures in current supplies. As a result, conventional structures can not achieve a reliable connection and so it is desirable to have an improvement made on this aspect.

The object of the invention is to provide an improved structure in which the above-mentioned problem has been overcome and that can prevent the connection between light bulb series and sockets from loosening. More than that, the new structure according to the invention can provide an unparalleled blinking effect that can not be produced by a conventional one.

Now the structure and features of the invention will be described in detail with reference to the accompanying drawings.

BRIEF DESCRIPTION OF THE ACCOMPANYING DRAWINGS

FIGS. 1 through 5 depict various embodiments of the improved arrangements of light bulb series according to the invention.

DETAILED DESCRIPTION OF THE INVENTION

Figure 1:
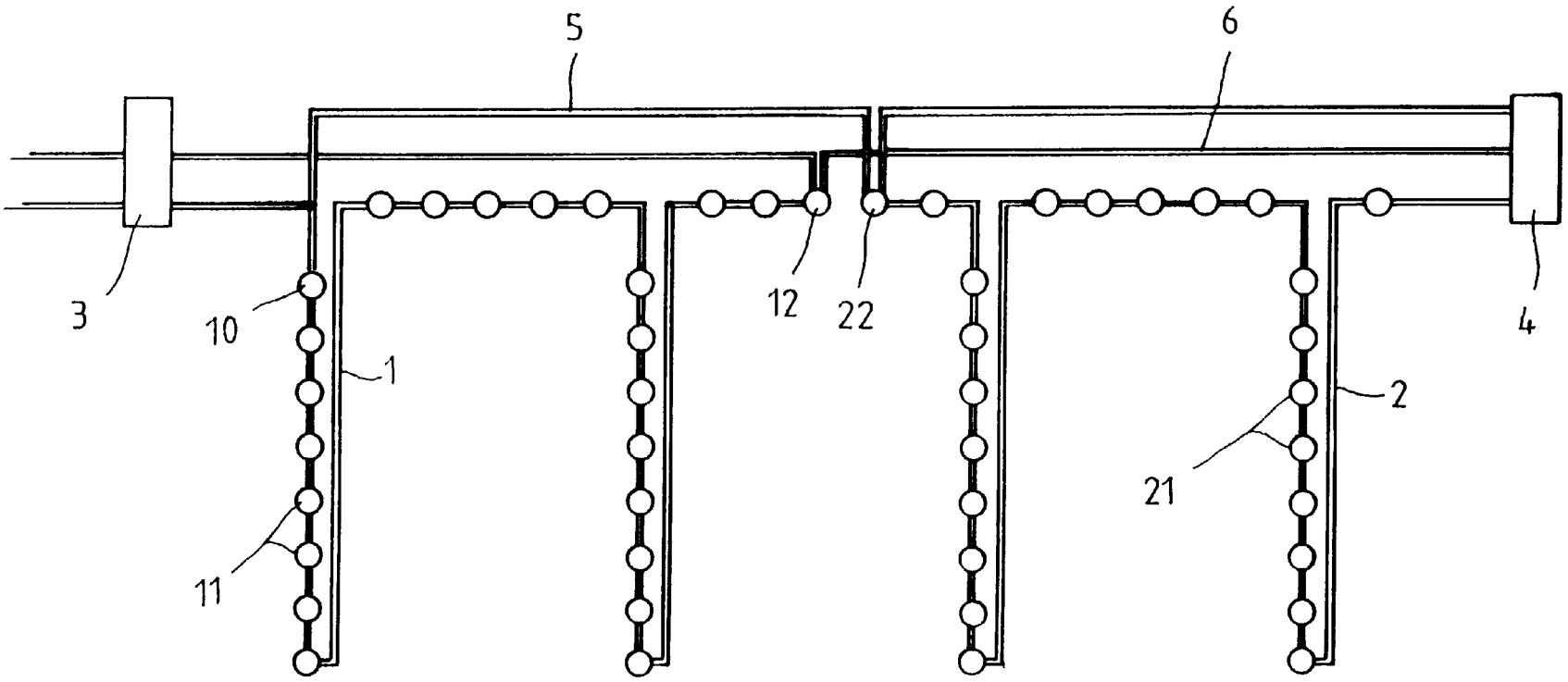

With reference to FIG. 1, the first embodiment of the invention includes a first and a second conductive wire (1) and (2) in a form of consecutive sharp turns, to each of which conductive wires a plurality of miniature light bulb series (11) and (21) is attached. Those light bulbs are arranged in a manner that the numbers of light bulbs of each column along the vertical direction are the same. The numbers of light bulbs of each row in the horizontal direction may be different. The first conductive wire (1) extends at its two ends to a first controller (3) and then links to a power source. The second conductive wire (2) also extends at its two ends in an opposite direction to a second controller (4). A connecting conductive wire (5) links the first light bulb (10) of the conductive wire (1) at one end with the last light bulb (22) of the second conductive wire (2) at the other end. Another connecting conductive wire (6) links to the last light bulb (12) of the first conductive wire (2) at one end and extends to a second controller (4) at the other end so that two conductive wires form a serially connected light bulb sees having a parallelly connected effect. The whole light bulb series has secure connections and so can be hung without danger of dropping.

Figure 2:
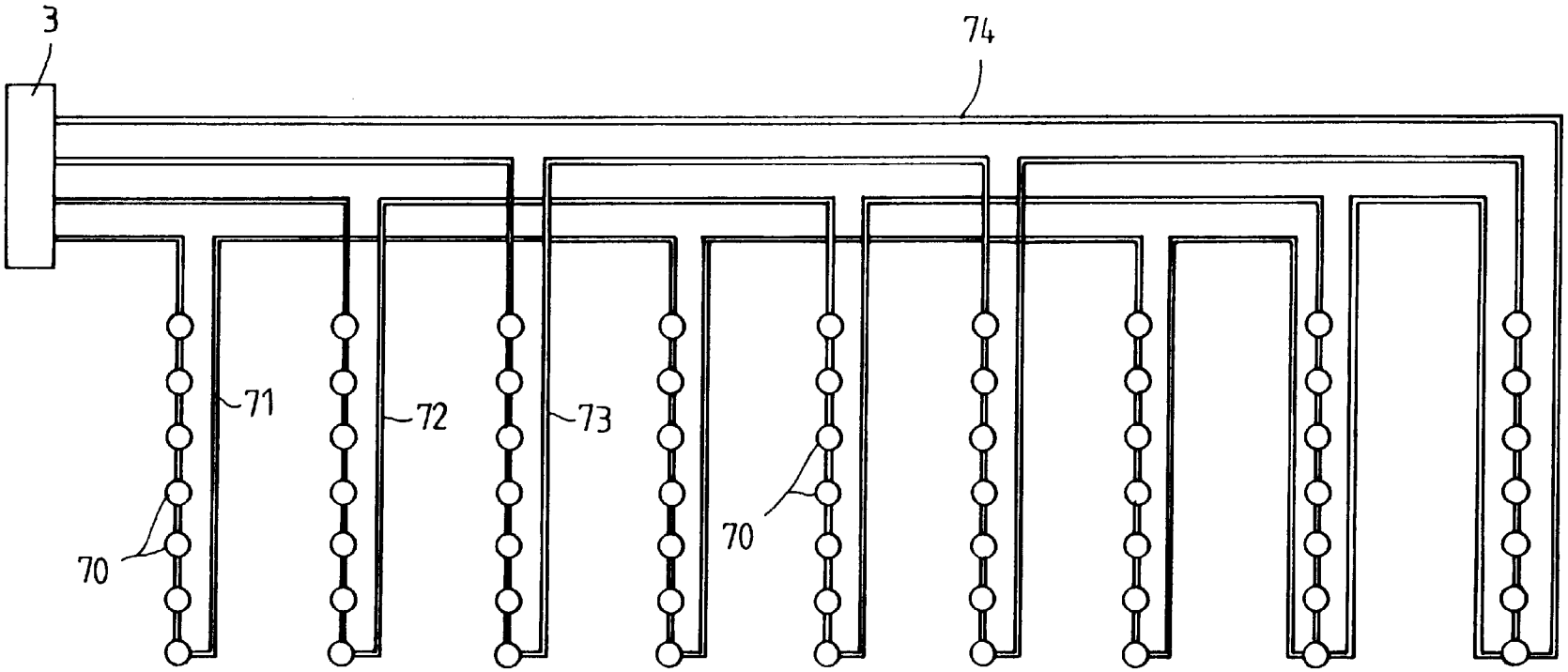

Referring to FIG. 2, the second embodiment of the invention includes a first, a second, and a third conductive wire (71), (72), and (73) each of which is attached to a controller (3) at one end. These conductive wires turn in a perpendicular form, with light bulbs (70) disposed in vertical directions. Three wires connect to each other at one end and attach to a connecting wire (74) that extends to the controller (3). The arrangement provides convenience in hanging.

Figure 3:
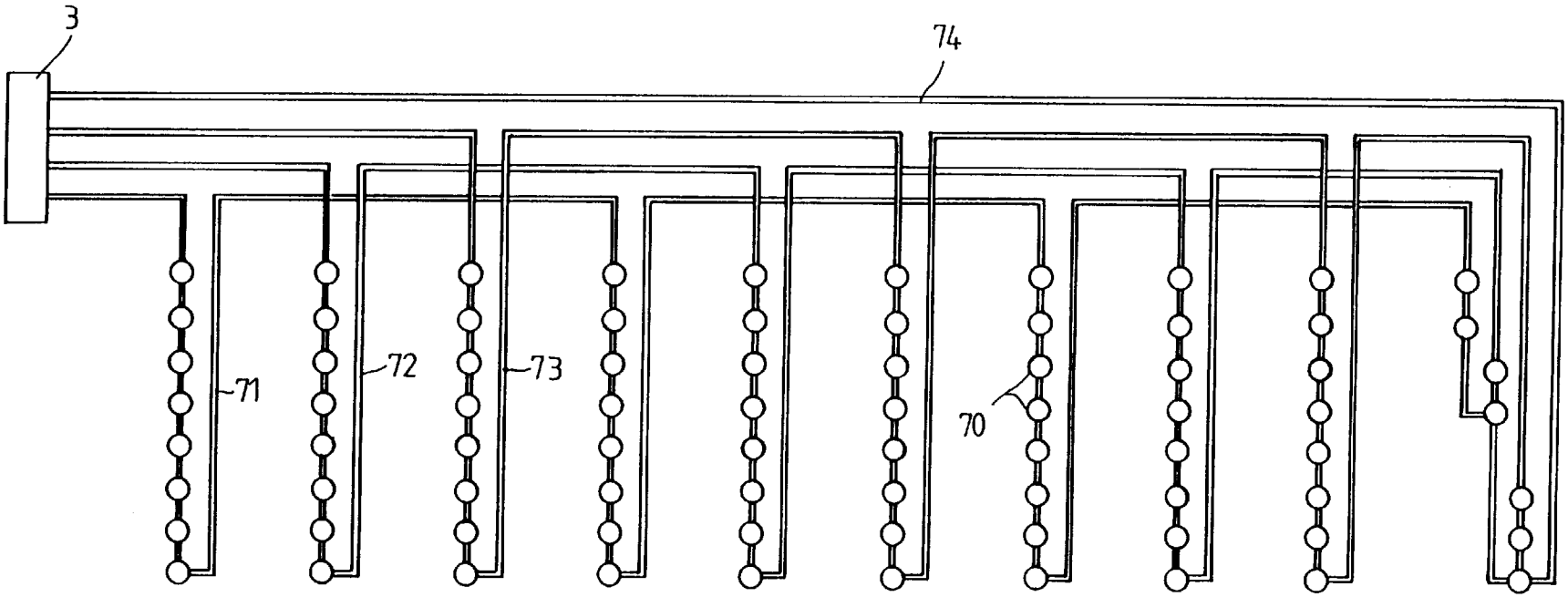
Figure 4:
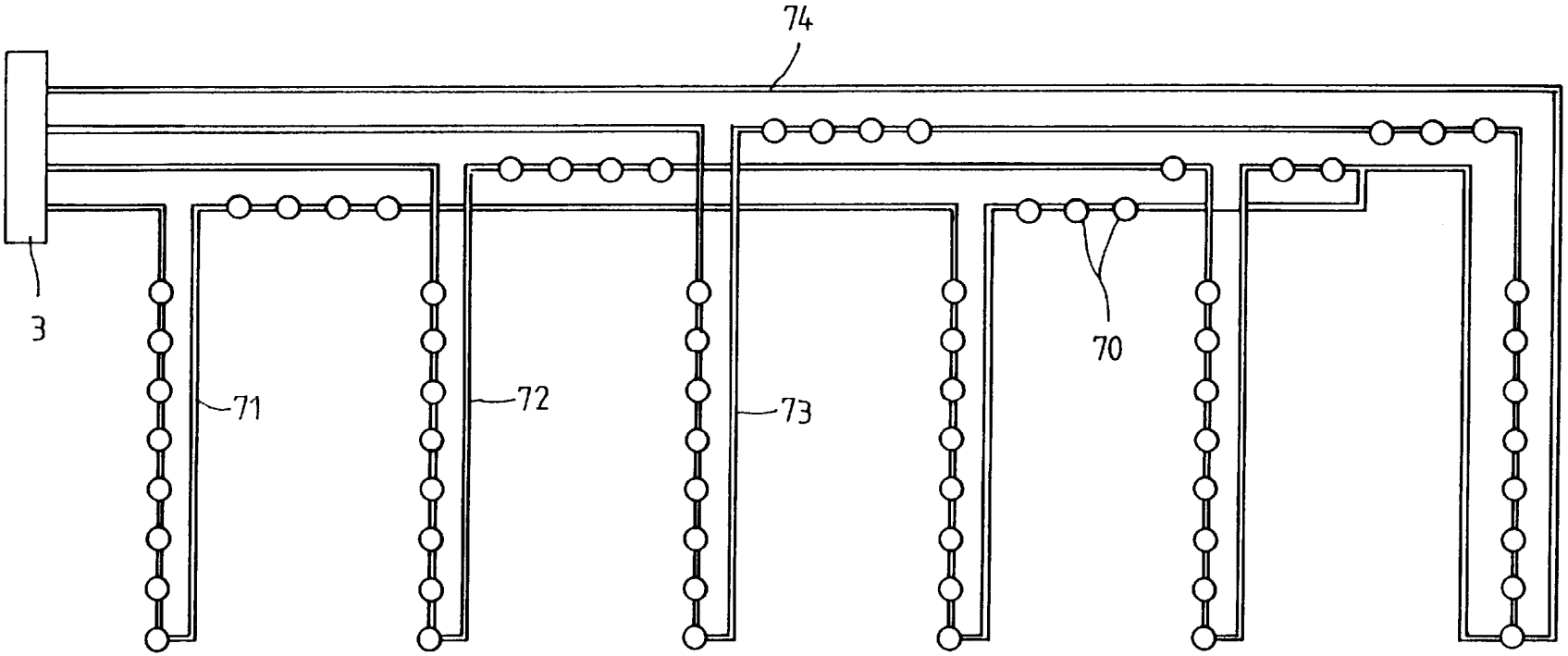
Figure 5:
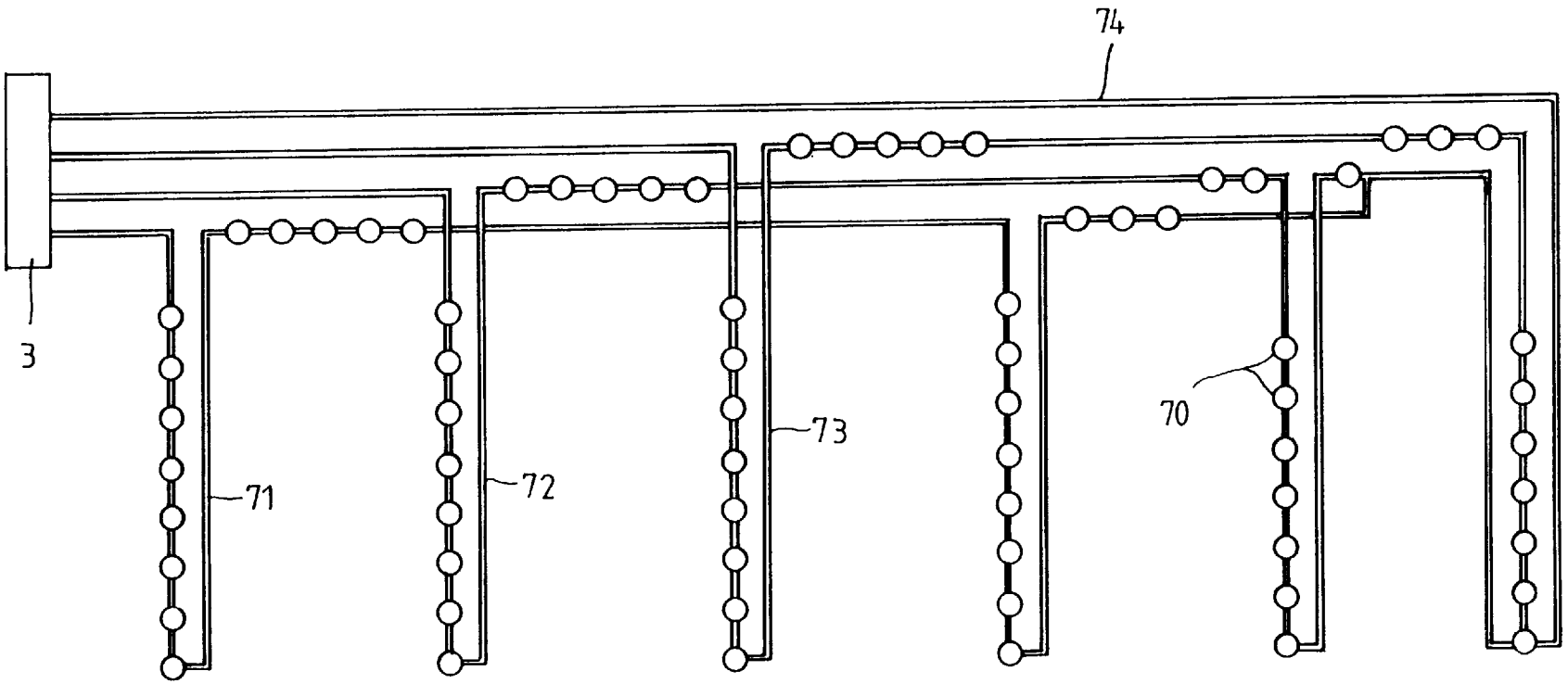

FIGS. 3 through 5 show a variety of embodiments according to the invention. They principally differ in the position arrangements of light bulbs, providing similar effects. Such a practical light bulb arrangement structure has promoted advantages that have not been found in a conventional one.

From the above description, the invention uses conductive wires to link light bulbs in a serial or parallel form, with consecutive sharp turns. Such inventive arrangements are evidently useful for the industry and eligible for a patent grant.

What is claimed is:

1. A structure used for rectangularly arrayed miniature light bulb series comprising:

a first light bulb string having a plurality of light bulbs electrically connected in series, said first light bulb string having a first lead light bulb and a first end light bulb;

a second light bulb string having a plurality of light bulbs electrically connected in series, said second light bulb string having a second lead light bulb and a second end light bulb;

a first controller electrically coupled to a power source and having first and second primary electrical terminals, said first primary electrical terminal electrically coupled to said first lead light bulb and to a first primary end of a first conductive wire, said first conductive wire having a second primary end electrically coupled to said second end light bulb, said second primary electrical terminal electrically coupled to said first end light bulb;

a second controller having first, second, and third secondary electrical terminals, said first secondary electrical terminal in electrical communication with said second lead light bulb, said second secondary electrical terminal electrically coupled to a first secondary end of a second conductive wire, said second conductive wire having a second secondary end electrically coupled to said first end light bulb, said third secondary electrical terminal in electrical communication with said second end light bulb.

2. A structure used for rectangularly arrayed miniature light bulb series comprising:

a first light bulb string forming a plurality of light bulbs electrically connected in series, said first light bulb string having a first lead light bulb and having a first end light bulb;

a second light bulb string forming a plurality of light bulbs electrically connected in series, said second light bulb string having a second lead light bulb and having a second end light bulb, said second end light bulb in electrical communication with said first end light bulb;

a third light bulb string forming a plurality of light bulbs electrically connected in series, said third light bulb string having a third lead light bulb and having a third end light bulb, said third end light bulb in electrical communication with said second end light bulb;

a controller electrically coupled to a power source and having first, second, third, and fourth electrical terminals, said first electrical terminal in electrical communication with said first lead light bulb, said second electrical terminal in electrical communication with said second lead light bulb, said third electrical terminal in electrical communication with said third lead light bulb, said fourth electrical terminal in electrical communication with said third end light bulb.

3. A structure used for rectangularly arrayed miniature light bulb series as recited in claim 2 wherein said first, second, and third light bulb strings may be oriented in either the vertical or horizontal direction and the order in which said first, second, and third light bulb strings are hung may be in any desired combination.

* * * * *